United States Patent [19]

Bursk et al.

[11] 4,352,258

[45] Oct. 5, 1982

[54] ADJUSTABLE SILL AND THRESHOLD

[75] Inventors: William M. Bursk, Middletown, Ohio; Jacob G. Doll, Batesville, Ind.

[73] Assignee: Pease Company, Fairfield, Ohio

[21] Appl. No.: 174,761

[22] Filed: Aug. 4, 1980

[51] Int. Cl.[3] ..... E06B 1/70

[52] U.S. Cl. ..... 49/468

[58] Field of Search ..... 49/468, 467

[56] References Cited

U.S. PATENT DOCUMENTS

| | | | |
|---|---|---|---|
| 596,948 | 1/1898 | Seely | 49/468 |
| 646,465 | 3/1900 | Seely | 49/468 |
| 3,900,967 | 8/1975 | Bursk | 49/468 |

*Primary Examiner*—Kenneth Downey

*Attorney, Agent, or Firm*—Biebel, French & Nauman

[57] ABSTRACT

An adjustable sill and threshold assembly for a door in which a stationary sill base is provided with a longitudinally upwardly opening groove therein and in which a threshold is received in the groove and adapted for adjustable vertical movement therein, including a plurality of generally vertically extending longitudinally spaced adjusting screws which are rotatably captured in the threshold and extending in depending relation, and which are adjustable through apertures in the threshold, and a plurality of sheet metal channel-shaped screw retainer nuts are received and located in the base corresponding to the spacing of the screws and having an aperture for receiving one of said screws therein so that rotation of the screws causes a raising or lowering movement of the threshold.

1 Claim, 10 Drawing Figures

ADJUSTABLE SILL AND THRESHOLD

BACKGROUND OF THE INVENTION

This invention relates to adjustable sill and threshold assemblies and more particularly to such assemblies in which the height of an adjustable threshold may be varied by a simple screw driver adjustment.

SUMMARY OF THE INVENTION

The adjustable sill and threshold assembly of the present invention utilizes a plurality of screw members which are permanently captured within a recess formed in the adjustable threshold for engagement with a corresponding plurality of screw-receiving members or nuts received in a relatively stationary base, such that the raising and lowering movement of the threshold may be accomplished by rotation of one or more times of the adjusting screws. The arrangement of the present invention eliminates the need for the use of auxiliary or separate retaining screws to hold the adjustable threshold in place after adjustment thereof.

Preferably, the screw retainer or nut is formed of a piece of sheet metal which is located and retained in place by cut-outs or recesses formed in a base member.

The adjustable threshold member is provided with semi-arcuate retainers which provide a clearance space to receive the enlarged head of an adjustable screw, providing for rotation of the screw while capturing or entrapping the screw in place. The retainers are provided with an entrance ramp or surface which permit the retainer screw to be assembled in place by pressing to bring the screw head into the recess or cavity defined by the retainer members, and thereafter to trap and retain the head against inadvertent dislodgement. The head itself is provided with a boss section which extends in guided relation through a screw-driver aperture formed in the adjustable threshold.

The retaining nut is preferably formed of spring sheet steel material bent into a generally inverted channel shape and received within defined notches or cut-outs formed in the stationary base. Thus, the retainer nut is formed with a pair of depending leg members which are, in the relaxed position, normally somewhat spread apart from each other but which are pressed somewhat together to be inserted within the cut-outs or recesses formed in the base and thus essentially locked in place. Each of the sheet metal nuts is provided with a lanced opening, the edges of which form a spiral or semihelix, in the manner of a conventional metal fastener or retainer, to be received within the threads of the screw. The weight of the threshold and the weight applied to the threshold is transmitted to the plurality of screws at the screw shoulder, and the sheet metal retainer nut, being preferably formed of spring steel, transmits this weight directly to the base member, without the necessity for additional supporting or retaining structure.

It is accordingly an important object of this invention to provide an adjustable threshold in which a plurality of threaded fasteners or screw members are captured and retained for rotation within the adjustable threshold and which engage non-rotating fastener members, such as sheet metal nuts positioned in corresponding spaced relation along a stationary base member.

A still further object of the invention is the provision of an adjustable threshold assembly for a door which is positive in operation, simple to assembly, and low in cost.

These and other objects and advantages of the invention will be apparently from the following description, the accompanying drawings and the appended claims.

DETAILED DESCRIPTION OF THE PREFERRED EMBODIMENT

Figure 1:
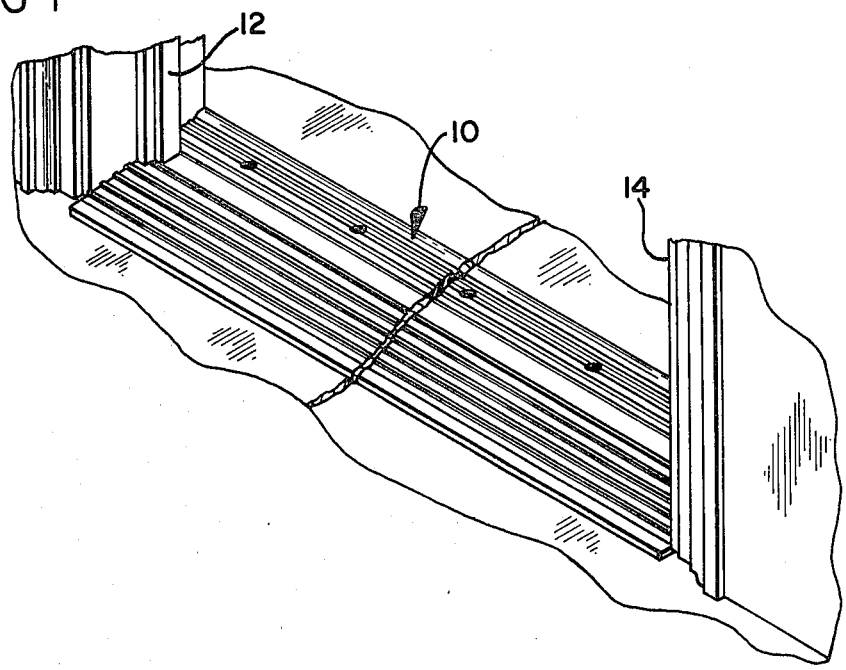
FIG. 1 is a perspective view, partially broken away, of a doorway incorporating the adjustable sill and threshold assembly of the present invention.
Figure 3:
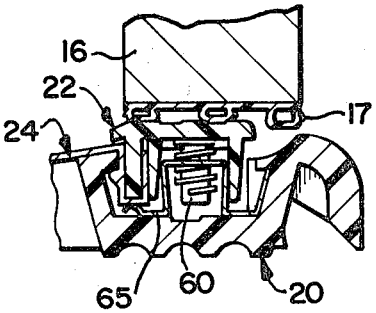
FIG. 3 is a fragmentary sectional view of a portion of FIG. 2 showing the lower portion of the door in place in the closed position above the adjustable threshold.
Figure 5:
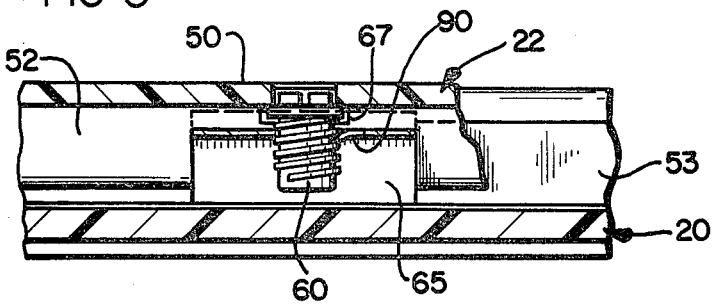
FIG. 5 is a longitudinal fragmentary sectional view through the assembly taken generally along the line 5—5 of FIG. 2.

A doorway incorporating the present invention, as shown in FIG. 1, includes the adjustable sill and threshold assembly illustrated generally at 10 extending transversely between opposed door jambs 12 and 14 and beneath a door 16 (FIG. 3). The door is mounted for pivotal movement on the jamb 14 by means of suitable hinges, in the conventional manner. It is understood that the door jamps 12 and 14 carry conventional weather stripping which engages with the front face of the door when the door is its closed position, and the bottom of the door 16, as shown in FIG. 3, is provided with a weather stripping strip 17.

Figure 2:
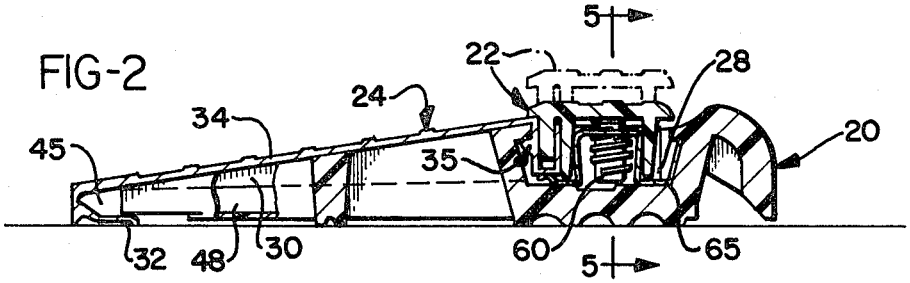
FIG. 2 is an enlarged cross-sectional view through the adjustable sill and threshold assembly.

As best seen in FIG. 2, the assembly 10 includes a molded stationary or non-moving base member illustrated generally at 20, a movable threshold 22, and metal tread or cladding 24. The molded base 20 constitutes a fixed sill provided with a generally upwardly opening threshold receiving groove or recess 28 formed therein, which groove or recess extends generally along an inner edge of the base 20. The base 20 is provided with a tread support portion 30 which projects somewhat downwardly and outwardly from the groove 28 area. It is further understood that the base 20 may include grooves adjacent the ends thereof, not shown, for receiving the lower ends of the jambs and trim members associated with the door.

The metal cladding 24, which is preferably formed of extruded aluminum material or the like, is supported on the tread support portion 30. The cladding 24 includes a heel portion 32 extending from a position beneath the tread support portion 30, with a generally tapered flat upper tread 34 and having a forward end 35, best seen in FIG. 4, which is generally U-shaped in section including a downwardly turned leg 36, a bottom web portion 37, and terminating in an upwardly projecting leg 38. The base 20, at the groove 28, is provided with an inwardly directed lip 40 over which the end 35 is received, and a longitudinally extending projection 42 formed on the cladding 24 is received and locked in underlying relation to the lip 40, thus to retain the cladding 24 in assembled position.

As noted in greater detail in the patent of Bursk et al, U.S. Pat. No. 3,900,967 issued Aug. 27, 1975 and assigned to the same assignee as this invention, the cladding 24 is spaced from the outer edge of the tread support portion 30 to form a moisture or water collection chamber 45 which extends along the length of the sill and communicates with drainage channels 48 formed in the tread support portion 30. The ends of the chamber 45 are open for drainage.

Figure 4:
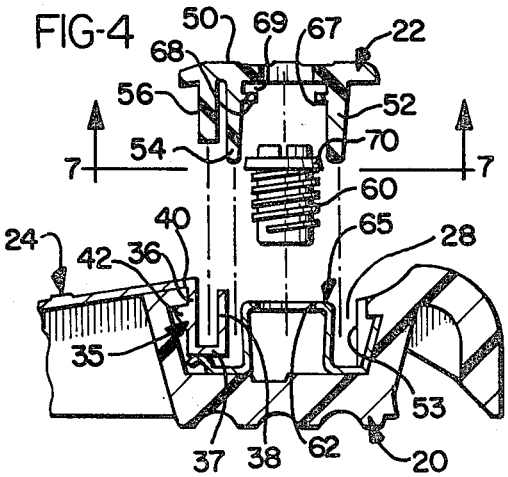
FIG. 4 is an exploded cross-sectional view of the parts shown in FIG. 3.
Figure 8:
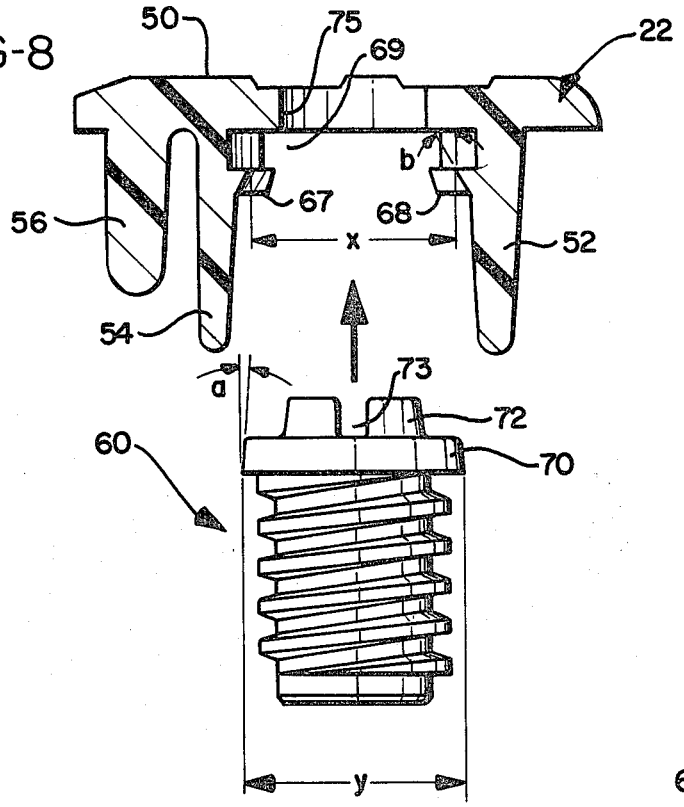
FIG. 8 is an enlarged view, showing the adjustable threshold in section, and the adjusting screw in elevation, prior to insertion of the screw in the threshold.

The movable threshold 22 is also formed of plastic material, and as shown in FIGS. 4 and 8, includes a cap portion 50, an integral downwardly extending leg 52 adapted to be positioned adjacent an inner wall 53 of the groove 28, and an opposed pair of generally parallel spaced legs including an inner leg 54 having dimensions similar to that of the leg 52 and an outer leg 56, the legs 54 and 56 comprising a forward generally parallel pair of legs formed integrally with the threshold 22 in depending relation therefrom. The legs 54 and 56 straddle the upwardly turned end or leg 38 formed on the channel end 35 of the cladding 24, and cooperate to form a labyrinth seal against the entry of moisture into the groove 28, as more fully described in the said Bursk et al patent.

Figure 10:
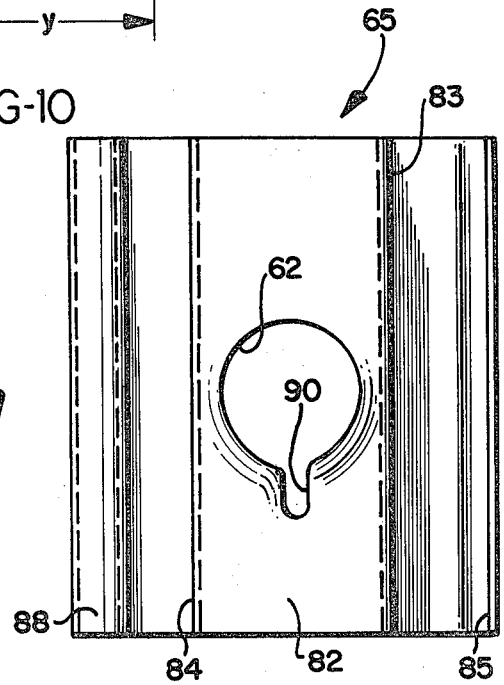
FIG. 10 is a plan view of the sheet metal retaining nut of FIG. 9.
Figure 9:
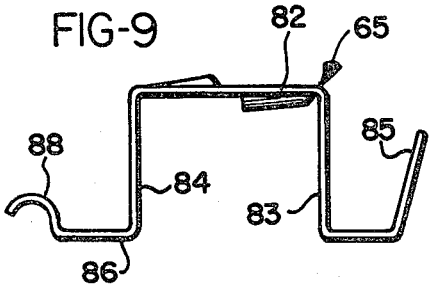
FIG. 9 is an enlarged end elevational view of the sheet metal retaining nut.

The adjustable sill and threshold assembly 10 of the present invention includes a plurality of longitudinally spaced screw-type adjusters. Each of these adjusters includes a molded sill adjusting screw illustrated generally at 60 in FIGS. 4 and 8 which, in the assembled position, is threadly received within a lanced opening 62 formed in the upper surface of a screw retainer or nut illustrated generally at 65, and the details of which are best seen in FIGS. 9 and 10.

Figure 7:
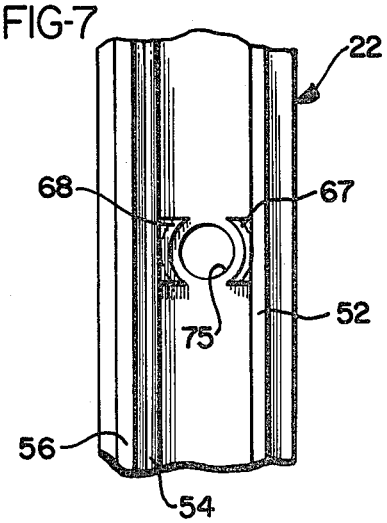
FIG. 7 is a view looking into the interior of the adjustable threshold, with the adjusting screw removed, as viewed generally along the line 7—7 of FIG. 4.

The assembly 10 of the present invention includes means in the threshold 22 for capturing the screw 60 and supporting the same for rotation. To this end, the inner surface of the threshold 22 is provided with an opposed pair of semi-circular or arcuate screw retaining ledges 67 and 68, extending slightly inwardly from the legs 52 and 54, as shown by the plan view of FIG. 7. The ledges 67 and 68 define a clearance space 69 with the cap portion 50 to receive the enlarged head 70 of the screw 60 while providing for free or unrestricted rotation of the screw 60.

As best shown in FIG. 8, the screw 60 is formed with a circular boss 72 formed on the head 70 having a diameter less than that of the head and which defines a screw-driver slot 73 therein. The boss 72 is proportioned to be received within a clearance opening 75 formed in the cap portion 50 of the threshold 22 when the screw is assembled and captured by the ledges 68 and 67. Preferably, the screw 60 is formed of any suitable hard material, such as metal or hard plastic, and the side walls of the head 70 are formed with a slight angle a as illustrated in FIG. 8 which may be in the order of 5° of less. The opposed arcuate faces 75 of the ledges are provided with a conical taper which decreases in diameter toward the cap 50 which an angle b in the order of approximately 30°. The transverse dimension of the opening defined by the faces 75 of the ledges, as shown by the dimension "X", is somewhat less than the maximum diameter of the head 70 as identified by the dimension "Y" so that the ledges are somewhat deformed as the screw head 70 is pressed into place within the recess 69. For example, the head 70 may have a dimension "Y" of 0.580" while the clearance dimension "X" may be in the order 0.530". Preferably, the threshold 22 is formed of a semi-rigid structural plastic foam material, (for example, Styrene) which may be slightly deformed under force to admit the head 70 into the recess 69 and thereafter retain the screw captured in place, with the boss portion 72 extending partially into the clearance opening 75, so that the screw 60 is then free to be rotated by application of a screw driver thereto.

The inner wall or back surface 53 of the groove 28 formed in the base 20 is undercut at selected portions to form a plurality of transversely spaced grooves or recesses 80 (FIG. 6), corresponding to the transverse spacing of the screws 60 in the threshold 22 to receive and locate the sheet metal fasteners or nuts 65. As best shown in FIGS. 9 and 10, the nuts 65 are proportioned to be received within the recess 28 and are formed essentially of flat strip metal material, such as spring steel. Each of the nuts 65 is formed with a generally inverted channel-shaped central section which includes a screw-receiving land or web 82 and a pair of downwardly turned legs 83 and 84. The leg 83 is further terminated in an upwardly and somewhat outwardly turned end 85 which is proportioned to be received in one of the recesses 80. The leg 84 is terminated in a transversely extending portion 86 which, in turn, defines a raised or curved portion 88 thereon.

The web or top 82 of the sheet metal nut 65 is lanced as indicated at 90 in FIG. 10 to form the screw-receiving opening 62 in which the metal defining the opening 62 is twisted into a semi-helix so as to receive the threads of the screw 60.

Figure 6:
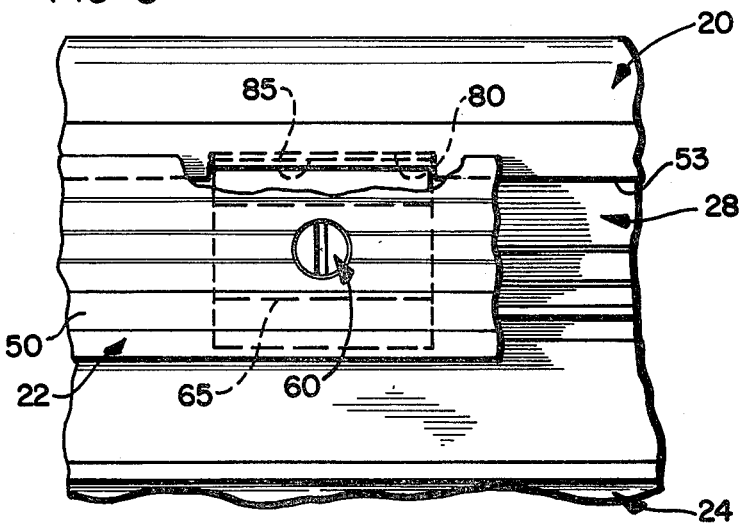
FIG. 6 is a partially broken away plan view of the assembly.

The upwardly turned end 85 is proportioned to be received in one of the cut-out or undercut recesses 80 formed in the base 20, as shown in FIG. 6, and thus locates the nut 65 at its desired longitudinal spacing in the channel 28 with respect to the longitudinal spacing of the screw 60 carried by the threshold 22. When it is so spaced, the opposite leg 84 and the adjacent upwardly turned end or leg 38 of the treading 24 defines a space therebetween into which the depending leg 54 of the threshold 22 is received in the assembled condition. This transverse space is somewhat less than the thickness of the leg 54 to form a slight interference fit so that the nut 65 is urged to the right when viewed in FIG. 4, thus locking the upwardly turned end 85 into its associated recess 80, and further urging the channel section 35 to the left as viewed in FIG. 4, thus locking the projection 42 thereon under the lip 40. The upwardly curved or raised portion 88 engages the channel section 35 at the web portion 37 and further assures the interlocking of the cladding 24 with the base 20.

The operation of the invention is largely self-evident from the foregoing description. The individual adjusting screws 60 will be preassembled with the movable threshold 22 so that the head 70 thereof is received within the space 69 and effectively captured in place on the threshold, with the screwdriver slot 73 being accessible through the clearance opening 75 of the threshold. Further, the sheet-metal fasteners or nuts 65 may be preassembled within the base 20 in the manner indicated above. The height of adjustment of the movable threshold 22 may thus be regulated by rotating the individual screws 60 either to raise or lower the threshold, as indicated by the broken line view of FIG. 2. The adjustment mechanism will thus be self-holding in any adjusted position, eliminating the need for auxiliary or secondary fastener or retaining means for maintaining such an adjusted position. Further, the movable threshold 22 may be selectively adjustable, as desired, to raise or lower either end thereof to accommodate for any misalignment of the bottom of the door 16 with the top 50 of the threshold.

While the form of apparatus herein described constitutes a preferred embodiment of this invention, it is to be understood that the invention is not limited to this precise form of apparatus, and that changes may be made therein without departing from the scope of the invention.

What is claimed is:

1. In an adjustable sill and threshold assembly for a door in which a stationary sill base is provided with a longitudinally upwardly opening groove therein and in which a threshold is received in the groove and adapted for adjustable vertical movement therein, the improvement comprising:

said threshold being formed of a yieldable plastic material having a cap portion;

a plurality of generally vertically extending longitudinally spaced adjusting screws, means in said threshold rotatably capturing each of said screws in depending relation therefrom, and including a pair of opposed inwardly facing semi-circular ledges defining with said cap portion a shoulder-receiving clearance space proportioned to receive the head of one of said screws, the minimum transverse space between said ledges being somewhat less than the diameter of said head, said ledges being formed with curved opposed tapered surfaces which decrease in diameter toward said recess to accommodate said head and to deflect upon force applied to said screw to receive and capture said head in said clearance space;

each of said screws having means engageable with said threshold for supporting said threshold thereon, means in said threshold defining apertures for driver-access to said screws, and a plurality of sheet metal channel-shaped screw retainer nuts received in said base in spaced relation corresponding to the spacing of said screws and having means therein defining an opening for receiving one of said screws therein, whereby rotation of said screws through said aperture causes raising and lowering movement of said threshold.

* * * * *